US006112448A

United States Patent [19]

Gray et al.

[11] Patent Number: 6,112,448

[45] Date of Patent: Sep. 5, 2000

[54] FIREARM FOREARM SLING AND METHOD OF USE OF SAME

[76] Inventors: Robert Gray; Patricia Gray, both of P.O. Box 5240, Rocky Point, N.Y. 11778

[21] Appl. No.: 09/105,878

[22] Filed: Jun. 26, 1998

Related U.S. Application Data

[60] Provisional application No. 60/051,186, Jun. 30, 1997.

[51] Int. Cl.[7] ..... F41A 27/30

[52] U.S. Cl. ..... 42/94; 42/85

[58] Field of Search ..... 42/85, 94; 89/37

[56] References Cited

U.S. PATENT DOCUMENTS

| | | | |
|---|---|---|---|
| 202,946 | 4/1878 | Johnson . | |
| D. 271,512 | 11/1983 | Herst | D22/7 |
| D. 271,608 | 11/1983 | Finley | D22/7 |
| 279,706 | 6/1883 | Carroll . | |
| 562,487 | 6/1896 | Quackenbush . | |
| 1,027,556 | 5/1912 | Marshall . | |
| 1,117,748 | 11/1914 | Adison . | |
| 1,147,890 | 7/1915 | Purcell . | |
| 1,446,781 | 2/1923 | Benson . | |
| 1,453,706 | 5/1923 | Crosby . | |
| 2,112,577 | 1/1938 | Roberts | 42/85 |
| 2,116,618 | 1/1938 | Crockett | 42/85 |
| 2,296,733 | 9/1942 | Paolino . | |
| 2,357,363 | 9/1944 | Smith . | |
| 2,424,194 | 7/1947 | Sampson et al. . | |
| 2,481,834 | 9/1949 | Short . | |
| 2,608,733 | 9/1952 | Wilber . | |
| 2,779,521 | 1/1957 | Granberg . | |
| 2,830,747 | 4/1958 | Creste . | |
| 2,867,026 | 1/1959 | Gale . | |
| 3,162,966 | 12/1964 | La Coss . | |
| 3,184,877 | 5/1965 | Andrews . | |
| 3,319,852 | 5/1967 | Perkins . | |

(List continued on next page.)

*Primary Examiner*—Charles T. Jordan
*Assistant Examiner*—Denise J Buckley
*Attorney, Agent, or Firm*—Alfred M. Walker

[57] ABSTRACT

A gun barrel control target sling is applied to firearms, such as rifles, pistols, shotguns, bb guns, crossbows, and other hand held firing devices, such as rocket launchers, bazookas, etc. The target sling includes a flexible adjustable strap which extends obliquely downward from a forward part of a gun barrel in the vicinity of where the barrel is held by the non-trigger activating hand down to the forearm of the same arm of the shooter, to provide a counteracting force upon the repulsive explosive upward force of the gun when shot. This sling strap generally is a linearly extending strap approximately ½ inch by 24 inches, preferably having adjustable members, such as a series of corresponding slots into which fasteners can be placed to maximize a taunt fit between the gun and the forearm of the user. The downward oblique tension of the sling strap provides a counteracting force to upward movement of the gun. The longitudinally extending sling member is a flexible material such as leather or woven plastic and includes a swivel end portion engagable with another portion adjacent to the barrel of the gun. The target sling reduces or eliminates the undesirable upward movement of the barrel of the gun, such that when the gun is gripped and fired the sling provides a force directed downwards away from the muzzle of the gun, wherein the barrel does not significantly move from the aimed position prior to firing. The forearm is placed in the loop of the slings at the distal end of the sling.

12 Claims, 4 Drawing Sheets

U.S. PATENT DOCUMENTS

| | | | |
|---|---|---|---|
| 3,390,477 | 7/1968 | Galbraith | 42/94 |
| 3,570,162 | 3/1971 | Suddarth . | |
| 3,648,396 | 3/1972 | Smith | 42/94 |
| 3,861,070 | 1/1975 | Wild et al. | 42/85 |
| 3,885,250 | 5/1975 | Schiller | 2/321 |
| 3,927,808 | 12/1975 | Steen | 224/1 A |
| 4,182,469 | 1/1980 | Bennett | 224/150 |
| 4,280,644 | 7/1981 | Shindelka | 224/149 |
| 4,291,482 | 9/1981 | Bresan | 42/72 |
| 4,321,765 | 3/1982 | Gillum | 42/72 |
| 4,331,271 | 5/1982 | Anderson | 224/150 |
| 4,505,012 | 3/1985 | Johnson | 24/643 |
| 4,511,070 | 4/1985 | Hightower | 224/150 |
| 4,542,840 | 9/1985 | Pepper, Sr. | 224/150 |
| 4,555,051 | 11/1985 | Johnson | 224/150 |
| 4,571,872 | 2/1986 | Johnson | 42/85 |
| 4,760,944 | 8/1988 | Hughes | 224/205 |
| 4,817,835 | 4/1989 | Tarr, Jr. | 224/150 |
| 4,823,491 | 4/1989 | Llames | 42/85 |
| 4,823,998 | 4/1989 | Johnson | 224/150 |
| 4,864,761 | 9/1989 | Gregory | 42/75 |
| 4,982,522 | 1/1991 | Norton | 42/85 |
| 5,018,652 | 5/1991 | Holtzclaw, Jr. | 224/150 |
| 5,074,069 | 12/1991 | Shire | 42/85 |
| 5,075,996 | 12/1991 | Llames | 42/85 |
| 5,082,155 | 1/1992 | Salvador | 224/150 |
| 5,092,505 | 3/1992 | Ilschlager | 224/150 |
| 5,110,022 | 5/1992 | Dvoroznak et al. | 224/150 |
| 5,174,481 | 12/1992 | LeDune | 224/202 |
| 5,180,574 | 1/1993 | Troncoso, Jr. | 42/72 |
| 5,194,678 | 3/1993 | Kramer | 42/94 |
| 5,279,060 | 1/1994 | Watson | 42/96 |
| 5,282,558 | 2/1994 | Martinez | 224/150 |
| 5,323,940 | 6/1994 | Hart | 224/150 |
| 5,351,867 | 10/1994 | Vest | 224/224 |
| 5,353,538 | 10/1994 | Hakedal et al. | 42/85 |
| 5,564,610 | 10/1996 | Barron | 224/268 |
| 5,575,411 | 11/1996 | Hightower | 224/149 |
| 5,634,289 | 6/1997 | Wascher | 42/74 |
| 5,678,345 | 10/1997 | Gnade | 42/97 |
| 5,715,979 | 2/1998 | Crandall | 224/150 |
| 5,802,756 | 9/1998 | Hightower | 42/85 |
| 5,915,939 | 6/1999 | French | 42/85 |

FIREARM FOREARM SLING AND METHOD OF USE OF SAME

This application is a based upon Provisional Application Ser. No. 60/051,186, filed Jun. 30, 1997.

FIELD OF THE INVENTION

The present invention relates to stabilizing slings for firearms such as rifles, crossbows, handguns and the like.

BACKGROUND OF THE INVENTION

Slings generally constitute a flexible strap which is attached to two points of a rifle for carrying purposes.

In certain instances however, shorter target slings have been used to try and stabilize the shooting position of the gun by counteracting the repulsive upward force of the gun upon firing. Such target slings are attached from the forward part of the barrel of the gun to a region above the elbow around the biceps area of a shooter. Other target slings are attached around the hand or wrist of a shooter. However, there are disadvantages to either configuration of use.

First, the sling around the wrist is almost the same as holding the barrel of the gun in the hand so therefore it does not reduce the repulsive jerking of the gun upon firing. Furthermore, wrapping the sling around the biceps is also not entirely effective because it tends to provide a sling which extends longitudinally in a direction approximately parallel to the stock of the rifle. Such biceps engaging target slings do not extend obliquely downward at an angle, such as to the forearm of the user between the wrist and the elbow.

Furthermore, when aiming and firing shoulder held firearms such as rifles, the force of the gun counteracts the muscular holding power of the shooter holding the gun, thereby causing the barrel to shake and jerk upwards upon firing. This motion reduces the effectiveness of the shooter's aim upon firing, due to the up and down movements imparted by the barrel upon the firing of the gun. As noted above, a known method of reducing such movements is the use of flexible slings which are placed around the wrist or the upper arm of the user.

Among related target slings are those described in U.S. Pat. No. 5,715,979 of Crandall, which describes a rifle sling which extends from the front part of the rifle block to around the marksman's biceps area of the arm. U.S. Pat. No. 5,082,155 of Salvador is similar in configuration to the Crandall patent.

U. S. Pat. No. 5,353,538 of Hakedal describes a sling around both the upper arm and the hand of the shooter.

Furthermore, U.S. Pat. No. 5,351,867 of Vest describes a strap for an archer which extends upward from the belt of the archer to the forearm of the archer. Furthermore, U.S. Pat. No. 4,542,840 of Pepper describes a rifle sling similar to that of Crandall and Salvador, wrapping around the biceps.

U.S. Pat. No. 3,927,808 of Steen describes an elastic sling which attaches to the barrel of a rifle, which includes a wrist band for attaching to the wrist around the hand of the marksman.

U.S. Pat. No. 2,357,363 of Smith also describes a gun sling which is attached above the elbow around the biceps of the shooter.

U.S. Pat. No. 4,291,482 of Bresan describes a forearm support for a handgun which supports the firearm. But it is a rigid frame, not a strap.

U.S. Pat. No. 5,180,874 of Troncoso describes a device similar to that of Bresan.

Other rigid forearm supports for handguns include U.S. Pat. No. 3,162,936 of La Coss, U.S. Pat. No. 3,184,877 of Andrews, U.S. Pat. No. 1,027,556 of Marshall, and U.S. Pat. No. 3,648,396 of Smith.

These target slings and rigid supports do not provide a flexible but stable engagement of a target sling between a gun barrel and the forearm of a shooter. Furthermore, they do not provide a flexible annular clasp around the forearm of the shooter.

OBJECTS OF THE INVENTION

It is therefore an object of the present invention to provide a auxiliary flexible sling which can stabilize a gun barrel from jerking upward upon explosive force of firing.

It is a further object of the present invention to provide a sling which can maximize downward resistance against the upward movement of the barrel when fired.

It is a further object of the present invention to provide a comfortable sling which can also stabilize a rifle.

It is a further object of the present invention to provide a sling which can be attached to the forearm of the shooter to maximize stability of the weapon upon firing.

It is yet another object of the present invention to provide a target sling which includes a flexible annular clasp which securely engages around the forearm of a shooter to improve over the disadvantages of the prior art.

SUMMARY OF THE INVENTION

In keeping with these objects and others which may become apparent, the present invention relates to a gun barrel control target sling which can be applied to any firearm, such as rifles, pistols, shotguns, bb guns, crossbows, and other hand held firing devices, such as rocket launchers, bazookas, etc.

The target sling of the present invention can also be used with handguns as well as rifles. The target sling acts better than rigid forearm supports such as shown in the prior art, since such supports merely provide support for the arm in the shooting position and do not stabilize the gun by securely grasping and/or wrapping around the forearm of the shooter.

For rifles, the present invention includes the use of a flexible adjustable sling strap which extends obliquely downward from a forward part of a gun barrel, in the vicinity of where the barrel is held by the non-trigger activating hand, down to a forearm engaging loop engaging the forearm of the same arm of the shooter, to provide a counteracting force upon the repulsive explosive upward force of the rifle when shot. This strap generally is a linearly extending strap with dimensions of approximately ½ inch by 24 inches, preferably having an adjustable means, such as a series of corresponding slots into which fasteners can be placed, to maximize a taunt fit between the gun and the forearm of the user.

In another embodiment, instead of the strap loop around the forearm, another forearm engaging member includes a closable, hinged sleeve brace having a flexible or living hinge extending axially parallel to the axis of the arm inserted within the brace. The brace is attached to the target sling strap which extends between the brace and the gun barrel.

With respect to shoulder held firearms, such as rifles, shotguns, crossbows and the like, the purpose of the target sling is to have the downward oblique tension of the sling strap to provide a counteracting force against upward movement of a gun upon firing. Force is applied downward instead being applied parallel to the longitudinal direction of the gun.

Furthermore, extension of the sling strap from a rifle barrel to a forearm is better than use of the wrist, since the wrist just applies more grip at the point where the barrel is held by the non-shooting hand, and does not provide any downward pressure against the explosive upward force of the gun upon being shot.

The flexible target sling strap is portable, as it can be carried in the pocket or a backpack, etc. of the user. The strap reduces movement of a gun from wind or shifting of the body. It can also function as a temporary tourniquet, or medical arm sling etc. when not in use with a weapon. Preferably the longitudinally extending sling member is a flexible material such as leather or woven plastic, and includes a swivel end portion engagable with a fastener adjacent to the barrel of the gun. Other attachments such as hook and loop VELCRO® fasteners, buttons or snaps, can be used. The forearm is placed in the loop or brace of the sling at the distal end of the sling.

The present invention reduces or eliminates the undesirable upward movement of the barrel of the gun such that when the gun is gripped and fired the target sling provides a force directed downwards away from the muzzle of the gun such that the barrel does not significantly move from the aimed position prior to firing.

DESCRIPTION OF THE DRAWINGS

The present invention can be best be understood in conjunction with the accompanying drawings in which.

DETAILED DESCRIPTION OF THE INVENTION

Figure 1:
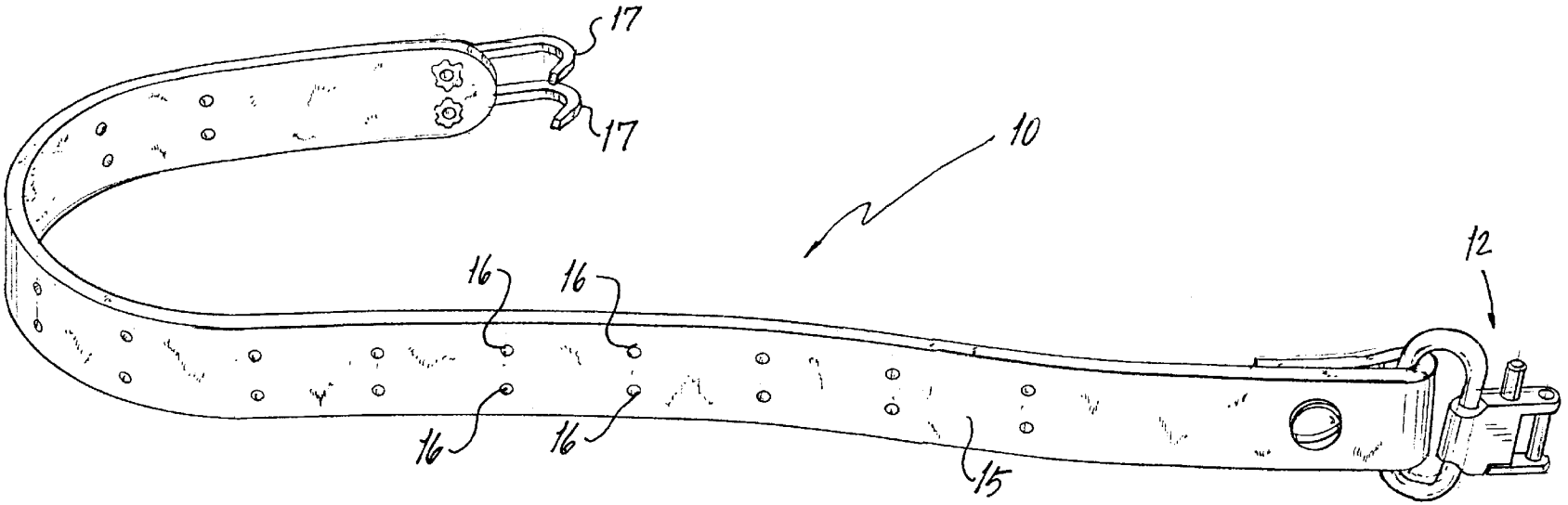
FIG. 1 is a perspective view of one embodiment for the target sling of the present invention.
Figure 2:
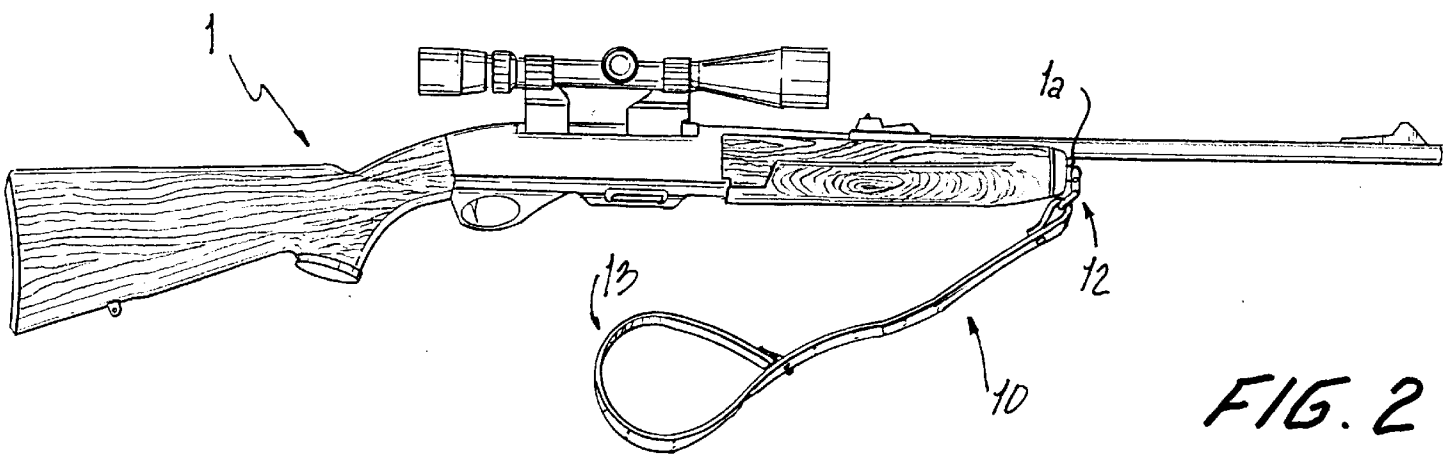
FIG. 2 is a perspective view of the target sling as in FIG. 1, shown installed upon a rifle.
Figure 3:
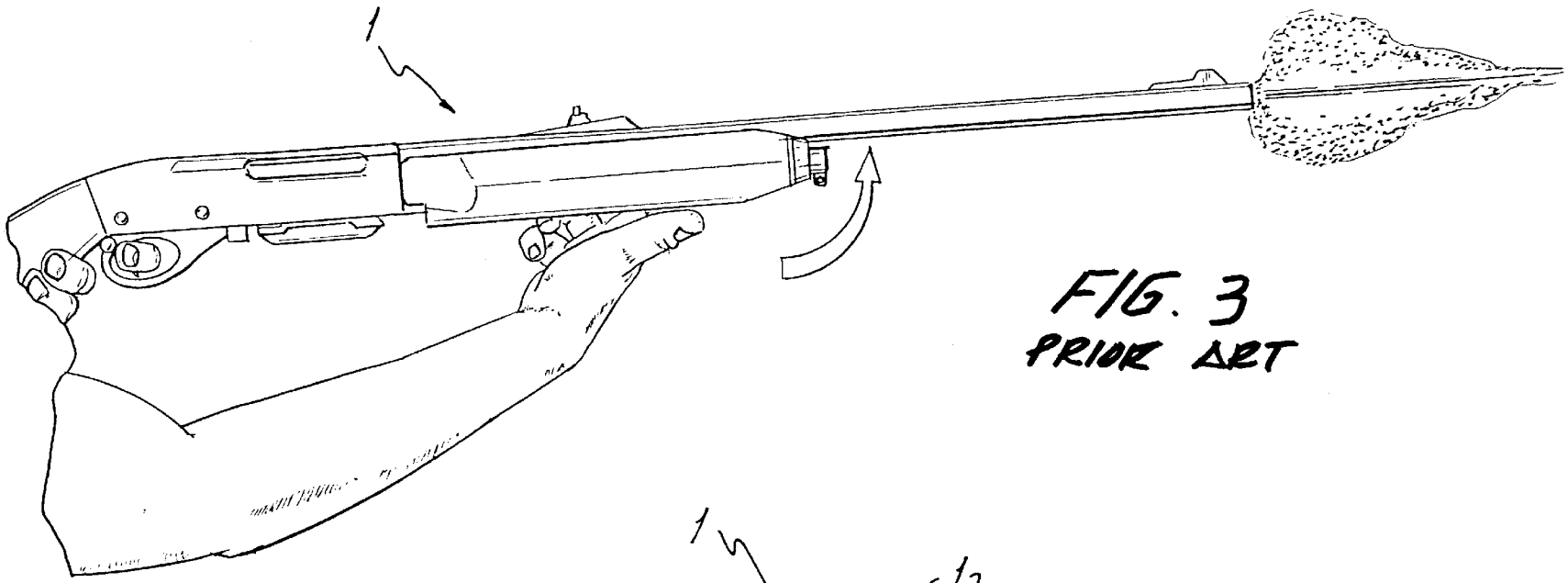
FIG. 3 PRIOR ART
FIG. 3 is a side elevational view of a prior art rifle recoiling upon firing.
Figure 4:
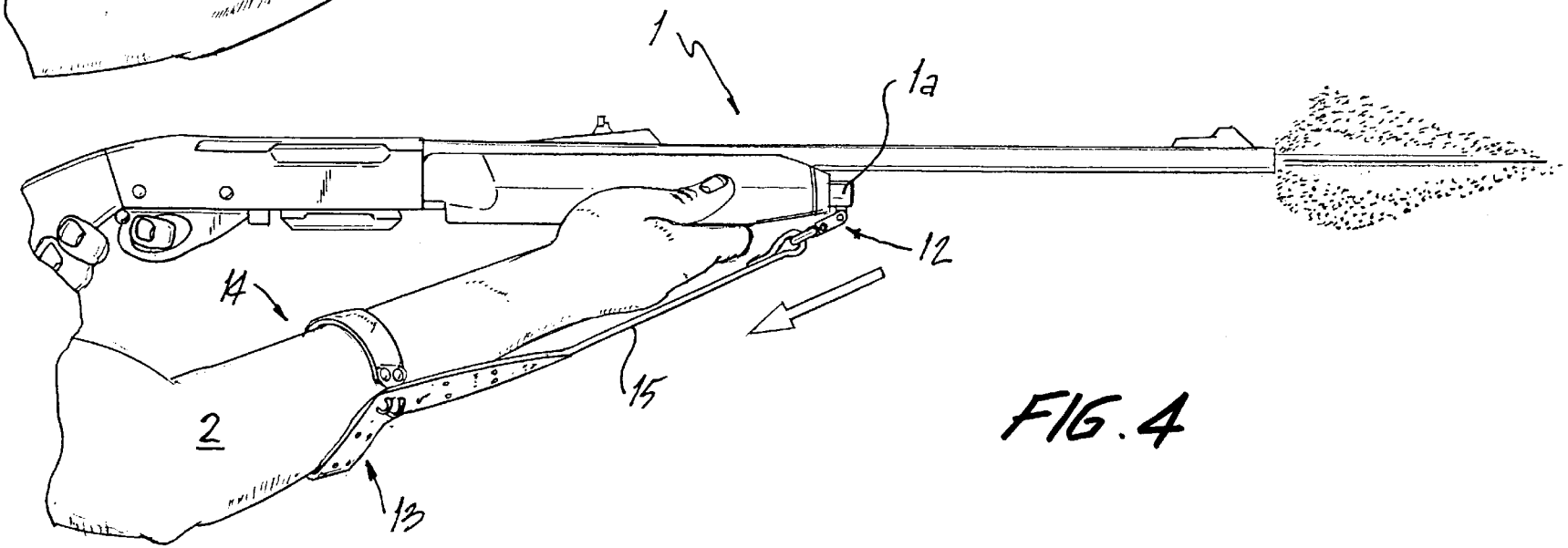
FIG. 4 is a side elevational view of the target sling as in FIG. 1, shown wrapped around the forearm of the user.

As shown in FIG. 3, a prior art rifle 1 is shown recoiling upward when fired as indicated by the directional arrow. As shown in FIGS. 1, 2 and 4, to prevent such violent recoiling, rifle 1 is secured to forearm 2 of a user by target sling 10 extending at a proximal end from fastener 12, attached to barrel stock 1*a* of rifle to forearm engaging loop member 13 around forearm 2 of the user, at distal end 14 of longitudinally extending strap body 15 of target sling 10.

Target sling 10 is preferably ½ to 1 inch in width, and approximately 24 inches in length, although the length of strap body 15 may vary by means of adjustment members, such as bores 16 engagable with prongs 17 inserted therein. Target sling 10 extends downward obliquely at a predetermined angle, as indicated by the directional arrow shown in FIG. 4, establishing an angular vector of target sling 10 off of a horizontal axis of rifle 1. Such downward placement provides tension against the upward recoiling of rifle 1, as shown in FIG. 3.

Figure 5:
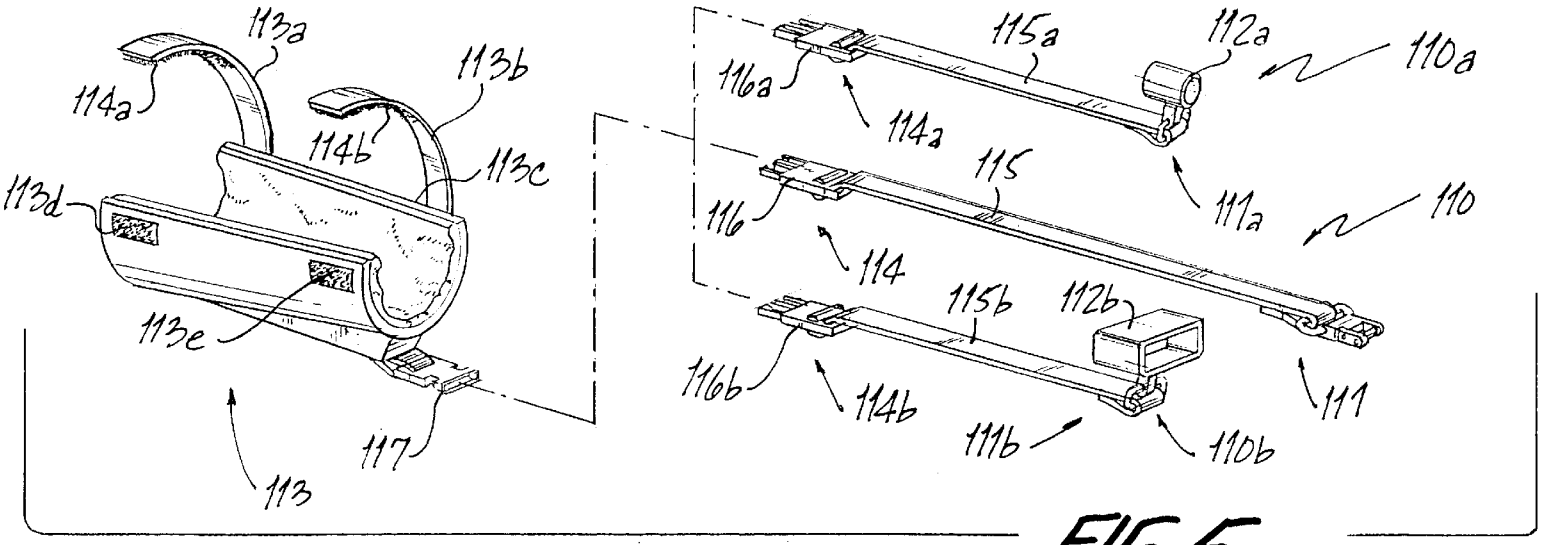
FIG. 5 is an exploded perspective view of an alternate embodiment for a target sling with a forearm engaging brace.
Figure 6:
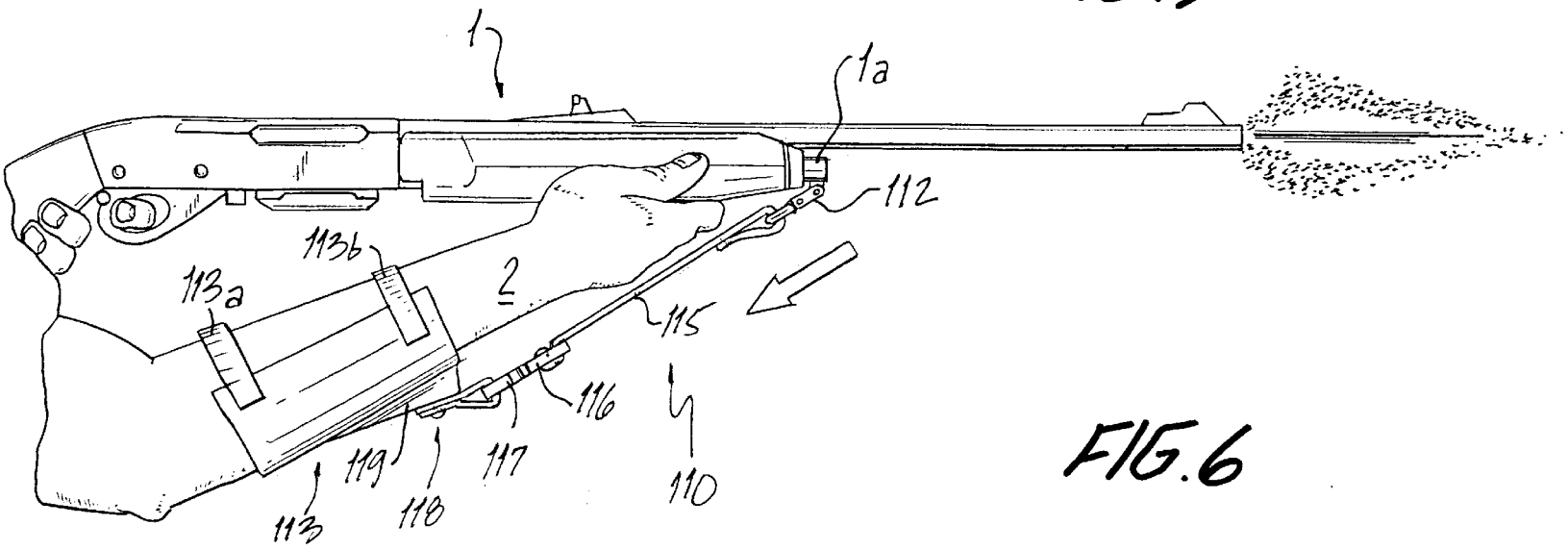
FIG. 6 is a side elevational view of the target sling as in FIG. 5, shown upon a rifle.

As shown in FIGS. 5–6, in other embodiments target sling 110, 110*a* or 110*b* extend at proximal ends 111, 111*a*, 111*b* with fasteners 112, 112*a*, 112*b* attached at proximal ends of flexible strap bodies 115, 115*a*, 115*b* to distal ends 114, 114*a*, 114*b* thereof, and thence to hinged concave sleeve brace 113 being hingably attached to one or more hinge straps 113*a*, 113*b*, attached at axially extending hinge 113*c*. Straps 113*a*, 113*b* are attached at one or more fastener regions 113*d*, 113*e* by one or more fasteners, such as a hook and loop VELCRO® type fastener 114*a*, 114*b*.

Flexible strap bodies 115, 115*a*, or 115*b* includes lockable clips 116, 116*a* or 116*b* with adjustment members (not shown) therein to lengthen or shorten the length of flexible strap bodies 115, 115*a* or 115*b*. Clips 116, 116*a*, 116*b* are engagable within hollow reciprocating clip 117, attached to target sling brace 113 by fastener 118 to shoulder 119 of brace 113. Because hinged sleeve brace 113 extends longitudinally along a mid region of the forearm 2 inserted therein, it prevents slippage, thereby securing hinged sleeve brace 113 upon the forearm 2.

Figure 7:
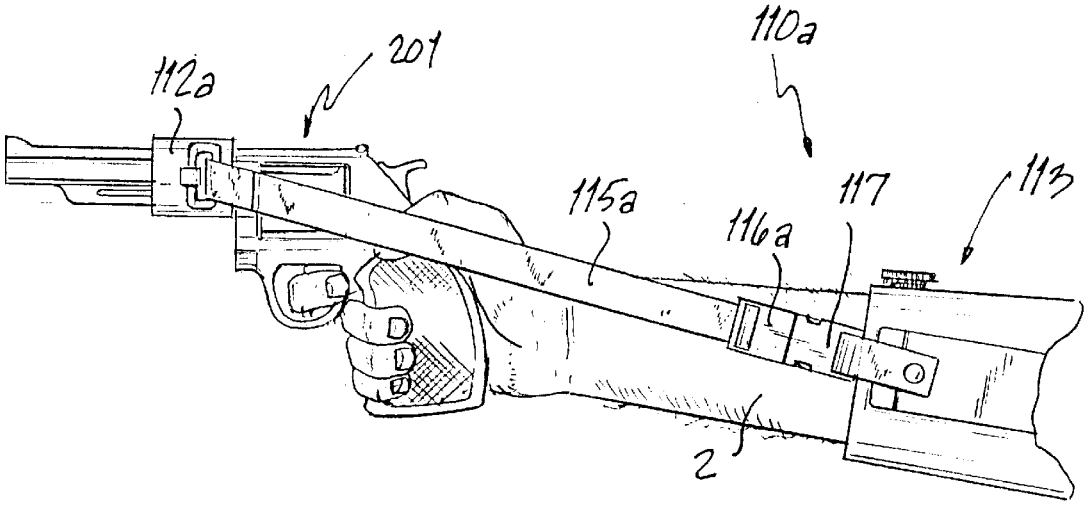
FIG. 7 is a side elevational view of the target sling as in FIG. 5, shown upon a revolver handgun.
Figure 8:
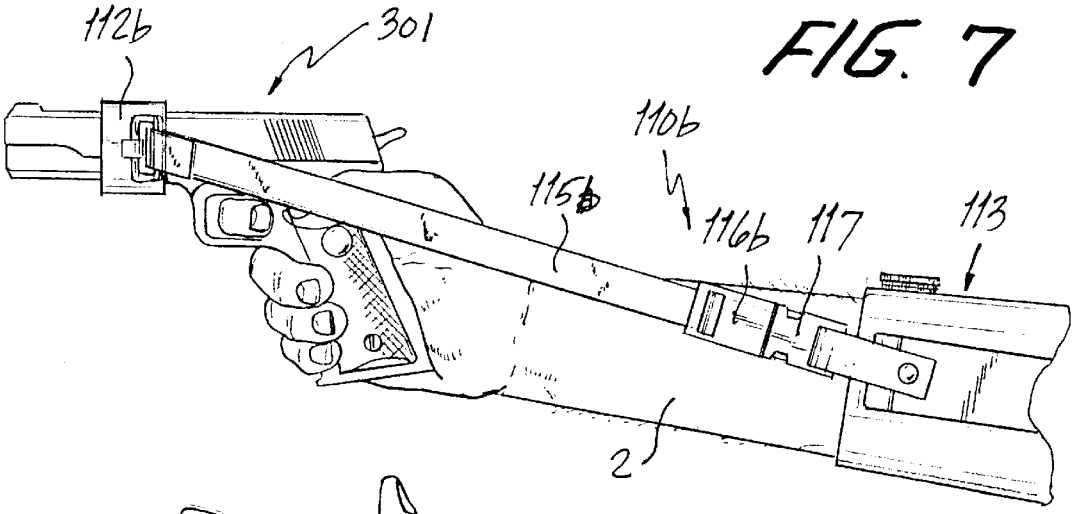
FIG. 8 is a side elevational view of the target sling in FIG. 5, shown upon an automatic handgun; and, FIG. 9 is an alternate embodiment for a target sling having a securement means around a trigger guard to prevent the gun from falling out of grasp when dropped.

FIG. 7 shows target sling 210 attached to revolver handgun 201. FIG. 8 shows sling 310 attached to automatic handgun 301.

Figure 9:
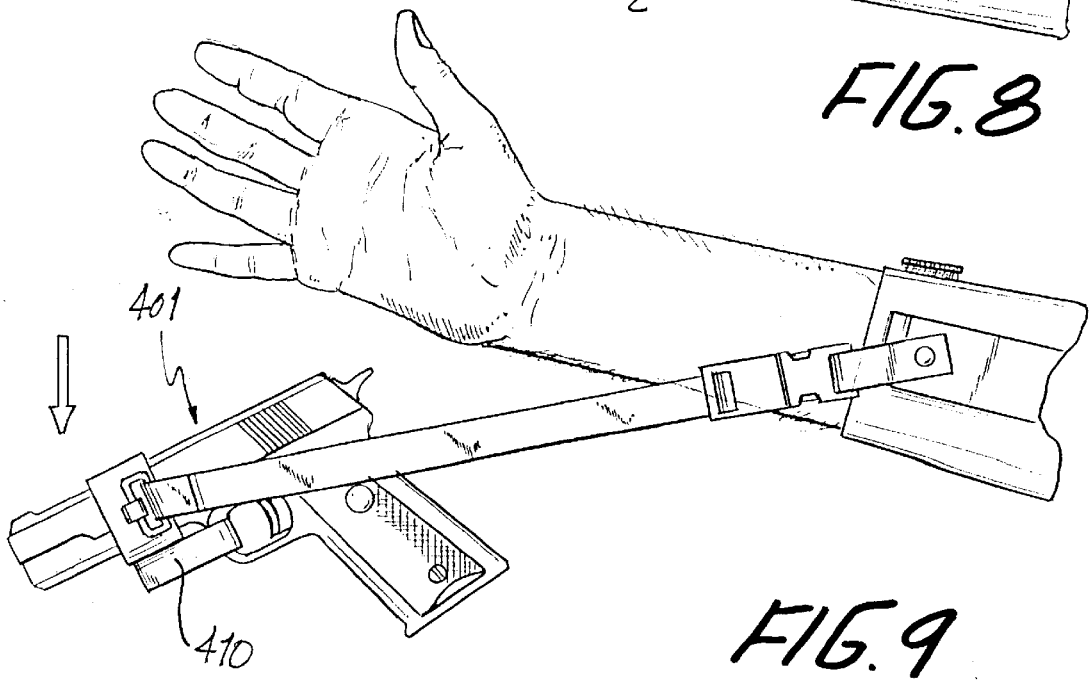

In a further embodiment shown in FIG. 9, securement means 410 is attached around a trigger guard of a handgun 401, so that the gun 401 is within reach if dropped.

Other modifications may be made to the present invention without departing from the scope of the invention, as noted in the appended claims.

What is claimed is:

1. A gun steadying device in combination with a gun for steadying the same during aiming and firing, said device comprising a combination:

an elongated sling made of a non-elastic flexible material, said sling being adapted to be secured about the forearm of the arm of the shooter supporting a gun barrel of the gun when holding the gun in a position for aiming and firing;

a fastening means secured to one end of said elongated sling, said fastening means engagable with a mounting means on the gun for pivotally attaching said fastening means to the gun and said elongated sling having a further means for tightening said elongated sling about the forearm of the shooter in a position in an oblique plane descending from the gun barrel of said gun;

the location of said mounting means on the gun, said fastening means and the length of said elongated sling being such that the placement of the hand of the gunner in the holding and aiming position applies a oblique downward force from the barrel of the gun towards the forearm of the user, thereby steadying the grip of the hand and the gun while being aimed and fired;

said tightening means includes a hollow concave sleeve brace attachable to at least one hinge strap joined along an axially extending common hinged edge of said sleeve brace, said at least one hinged strap removably joinable by at least one fastener thereof;

a lockable clip engagable with a further clip attached to said elongated sling; and a securement means attached to a trigger guard of said gun.

2. The device as in claim 1 wherein said sling comprises a flexible leather strap.

3. The device as in claim 1 wherein said sling comprises a flexible woven plastic strap.

4. The device as in claim 1 wherein said elongated sling includes a means for reducing the length of the said sling.

5. The device as in claim 4 wherein said length reducing means includes a plurality of holes engageble with fastener prongs therein.

6. A method of using an elongated sling for counteracting the upward undesirable force of a gun being held and fired by a user comprising the steps of:

providing a flexible sling strap having a maximum length extending from a forward position on the muzzle of the gun at a proximal end of said elongated strap, thereby providing an adjustable brace at the distal end of said elongated strap, said maximum length of said flexible sling strap being limited to a distance extending from said forward position of said sling strap on the muzzle of the gun to around the forearm of the non-shooting arm at a point approximately midway between the wrist and the elbow of the non-shooting arm of the user;

attaching the distal end of said sling strap to the forearm of the non-shooting arm at said point approximately midway between the wrist and the elbow of said forearm so that said sling strap runs along and parallel said forearm and provides tension against upward recoiling of said gun;

adjusting the length of said elongated sling strap so that said sling strap extends downward at an oblique angle from the muzzle of the gun towards the mid portion of the forearm of the non-shooting arm of the user; and, firing the gun and counteracting the up and down movement of the gun by applying downward pressure by the forearm of the user.

7. The method as in claim 6 wherein said sling comprises a flexible leather strap.

8. The method as in claim 6 wherein said sling comprises a flexible woven plastic strap.

9. The method as in claim 6 wherein said elongated sling includes a means for reducing the length of the said sling.

10. The method as in claim 9 wherein said length reducing means includes a plurality of holes engagable with fastener prongs therein.

11. The method as in claim 6 further comprising the steps of providing a tightening means including a hollow concave sleeve brace attachable to at least one hinge strap joined along an axially extending common hinged edge of said sleeve brace, and providing at least one hinged strap which is removably joinable by at least one fastener thereof.

12. The method as in claim 11 further comprising the step of providing a lockable clip engagable with a further clip attached to said elongated sling.

* * * * *